US009422041B2

(12) United States Patent
Gadler

(10) Patent No.: US 9,422,041 B2
(45) **Date of Patent: *Aug. 23, 2016**

(54) BUOYANCY VEST

(71) Applicant: WaveWrecker, LLC, El Cajon, CA (US)

(72) Inventor: Nicholas N. Gadler, El Cajon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/594,789

(22) Filed: Jan. 12, 2015

(65) Prior Publication Data

US 2015/0126086 A1 May 7, 2015

Related U.S. Application Data

(63) Continuation of application No. 13/769,718, filed on Feb. 18, 2013, now Pat. No. 8,961,252.

(60) Provisional application No. 61/600,441, filed on Feb. 17, 2012.

(51) Int. Cl.

| | |
|---|---|
| ***B63C 9/08*** | (2006.01) |
| ***B63C 9/115*** | (2006.01) |
| ***A41D 13/012*** | (2006.01) |
| *B63B 35/79* | (2006.01) |

(52) U.S. Cl.

CPC ..... *B63C 9/115* (2013.01); *A41D 13/0125* (2013.01); *B63B 2035/7903* (2013.01); *Y10T 29/49813* (2015.01)

(58) Field of Classification Search

CPC ..... B63C 9/115; A41D 13/0125
USPC ..... 441/115
See application file for complete search history.

(56) References Cited

U.S. PATENT DOCUMENTS

| | | | | |
|---|---|---|---|---|
| 5,459,874 | A | 10/1995 | Meredith | |
| 5,466,179 | A | 11/1995 | Jeffrey | |
| 8,808,048 | B2 | 8/2014 | Kent | |
| 8,961,252 | B2 * | 2/2015 | Gadler | A41D 13/0125 441/108 |
| 2005/0177922 | A1 | 8/2005 | Ikenaga et al. | |
| 2008/0188149 | A1 | 8/2008 | Curry | |
| 2010/0240272 | A1 | 9/2010 | Cosson | |

FOREIGN PATENT DOCUMENTS

| | | | |
|---|---|---|---|
| JP | 2003239116 | A | 8/2003 |
| RU | 2294677 | C2 | 3/2007 |
| RU | 97110 | U1 | 8/2010 |
| RU | 99932 | U1 | 12/2010 |

OTHER PUBLICATIONS

International Search Report and Written Opinion for related international Application No. PCT/US13/26607, dated Jun. 6, 2013, in 7 pages.

* cited by examiner

*Primary Examiner* — Stephen Avila
(74) *Attorney, Agent, or Firm* — Procopio, Cory, Hargreaves & Savitch LLP

(57) ABSTRACT

A buoyancy control apparatus for body surfing includes a buoyancy vest to be worn alone or under a body surfing suit or wetsuit, the vest having a plurality of spaced pockets with access openings on the exterior surface of the vest, and a plurality of foam inserts sized for fitting into the pockets via the access openings. The body surfer can regulate their buoyancy by adding foam inserts to the pockets or removing foam inserts from the pockets to enable them to maintain desired control and buoyancy balance in the water.

7 Claims, 3 Drawing Sheets

BUOYANCY VEST

CROSS-REFERENCE TO RELATED APPLICATIONS

This application is a continuation of application Ser. No. 13/769,718 filed on Feb. 18, 2013 which claims the benefit of U.S. Provisional Patent Application Ser. No. 61/600,441, filed Feb. 17, 2012, entitled "Buoyancy Vest", and the contents of the aforementioned applications are hereby incorporated by reference herein in their entirety.

FIELD OF THE INVENTION

The present invention relates, in general, to body surfing, and more particularly to a buoyancy control apparatus or body surfing buoyancy vest. More particularly, the present invention relates to a buoyancy vest to be worn under a body surfing suit or wetsuit which allows the buoyancy of the surfer to be adjusted in order to enable them to maintain desired control and buoyancy balance in the water.

BACKGROUND OF THE INVENTION

Body surfing is a way to enjoy the thrill of riding a wave in order to get the best ride the surfer must be buoyancy balanced. Body surfers, generally, simply extend their bodies horizontally, projecting their arms forward and in line with their body while allowing a breaking wave to drive them shoreward with the surf. To the body surfer, it is important to be able to ride waves of varied sizes, to enjoy a stable ride and to be able to control their bodies' direction and position and buoyancy on a wave face. Since a body surfer rarely uses any equipment other than swim fins, it is quite difficult for a body surfer to adequately control the stability of his ride and control his buoyancy.

The present invention seeks to overcome these limitations by providing the body surfer a means to stabilize his ride by controlling his/her buoyancy on the waves allowing his/her body to be in the proper position when the wave comes.

BRIEF DESCRIPTION OF THE DRAWINGS

The accompanying drawings, which are incorporated in and constitute a part of the specification, illustrate embodiments of the invention, and together with the description, serve to explain the objects, advantages, and principles of the invention. In the drawings.

DETAILED DESCRIPTION OF PREFERRED EMBODIMENTS

After reading this description it will become apparent to one skilled in the art how to implement the invention in various alternative embodiments and alternative applications. However, all the various embodiments of the present invention will be described herein, it is understood that these embodiments are presented by way of an example only, and not limitation. As such, this detailed description of various alternative embodiments should not be construed to limit the scope or breadth of the present invention as set forth below.

Figure 1:
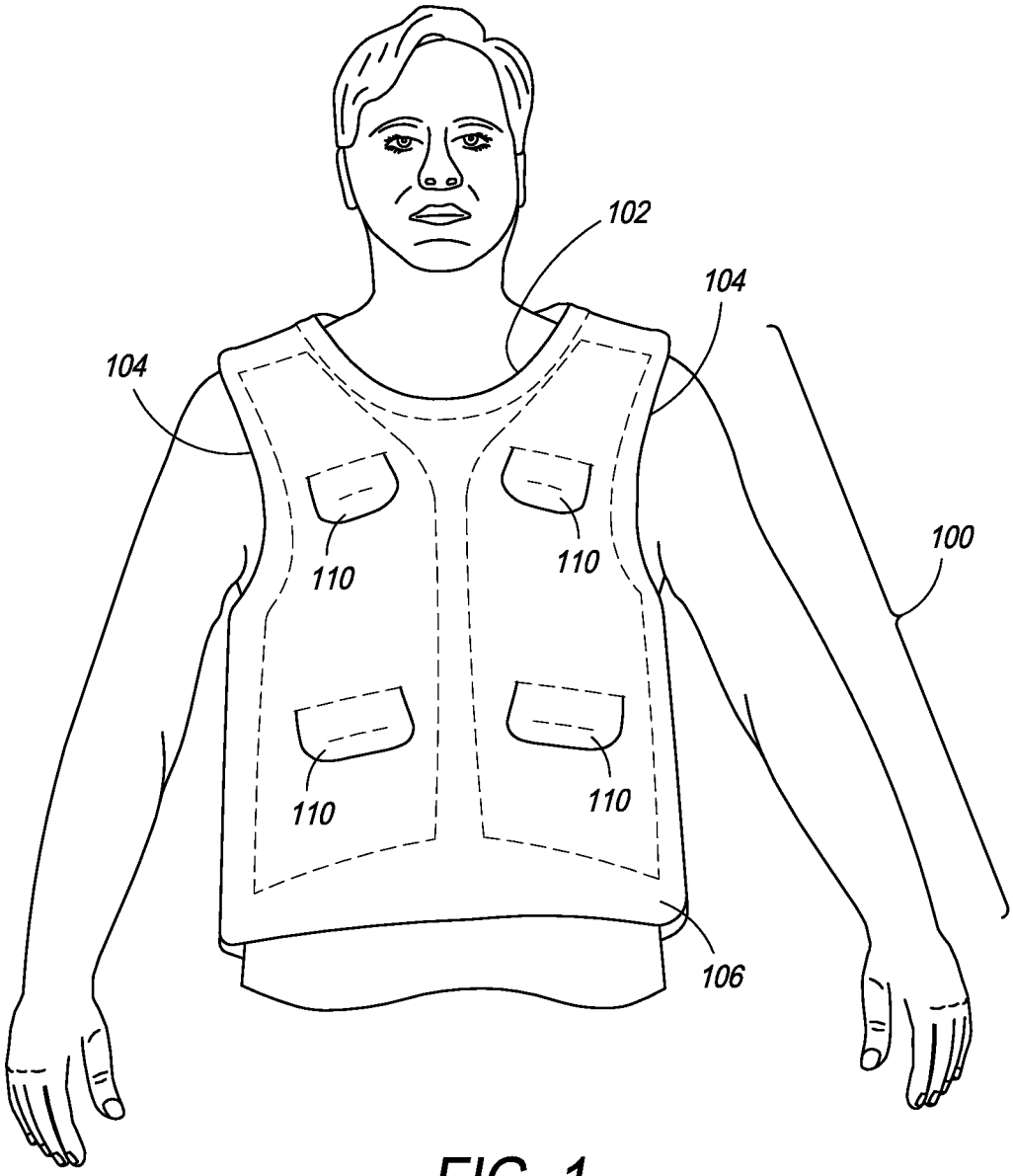
FIG. 1 is a front view of a buoyancy vest worn by a person in accordance with an embodiment of the invention.

With reference to FIG. 1, an embodiment of the buoyancy vest 100 is shown in a front view on a person. The buoyancy vest 100 is a vest worn on the user's upper torso to keep them more buoyant in the water. The buoyancy vest 100 includes a neck opening 102, a pair of arm holes 104, a front side 106 with an exterior surface and an interior surface, a back side 108 with an exterior surface and an interior surface (FIG. 2), pockets 110 on the front (FIG. 1) and rear side (FIG. 2) of the vest, and foam inserts 112 (FIG. 3) to be placed in the pockets 110. The buoyancy vest 100 is worn by a person either alone or under a surf suit or wet suit. In one embodiment the buoyancy vest 100 is pulled over the wearers head and meant to fit snuggly around the person's upper torso. The snug fit of the buoyancy vest 100 allows the user to be stream line in the water and does not allow water to sit between the inside of the vest 100 and the user's upper torso. In another embodiment the buoyancy vest 100 opens down the middle of on the front side 106 by means of a zipper, Velcro or other type of attachment, see FIG. 3, so that the person wearing the vest can easily put it on and still allow for it to fit snuggly around the upper torso.

Figure 2:
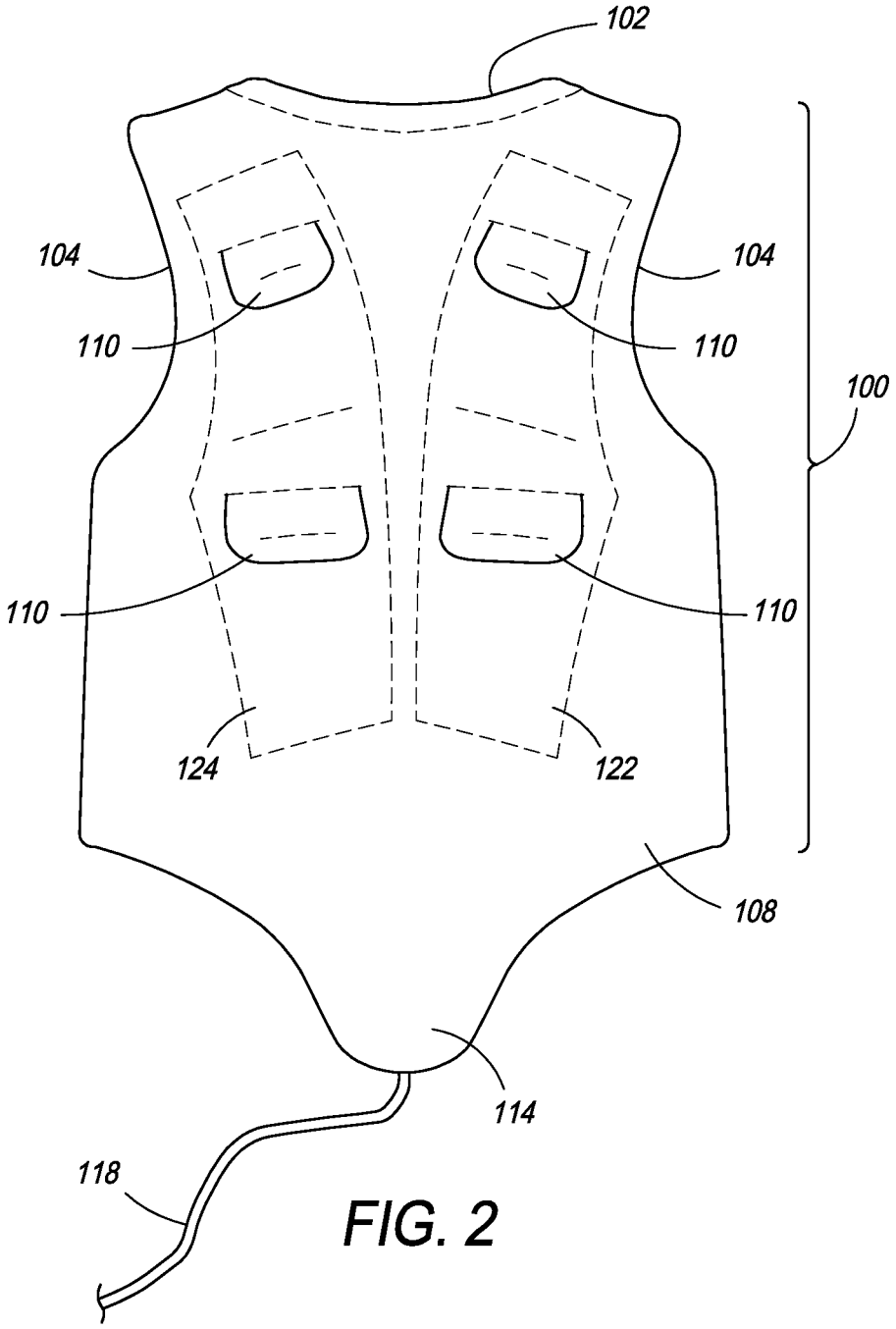
FIG. 2 is a rear view of a buoyancy vest in accordance with an embodiment of the invention.
Figure 3:
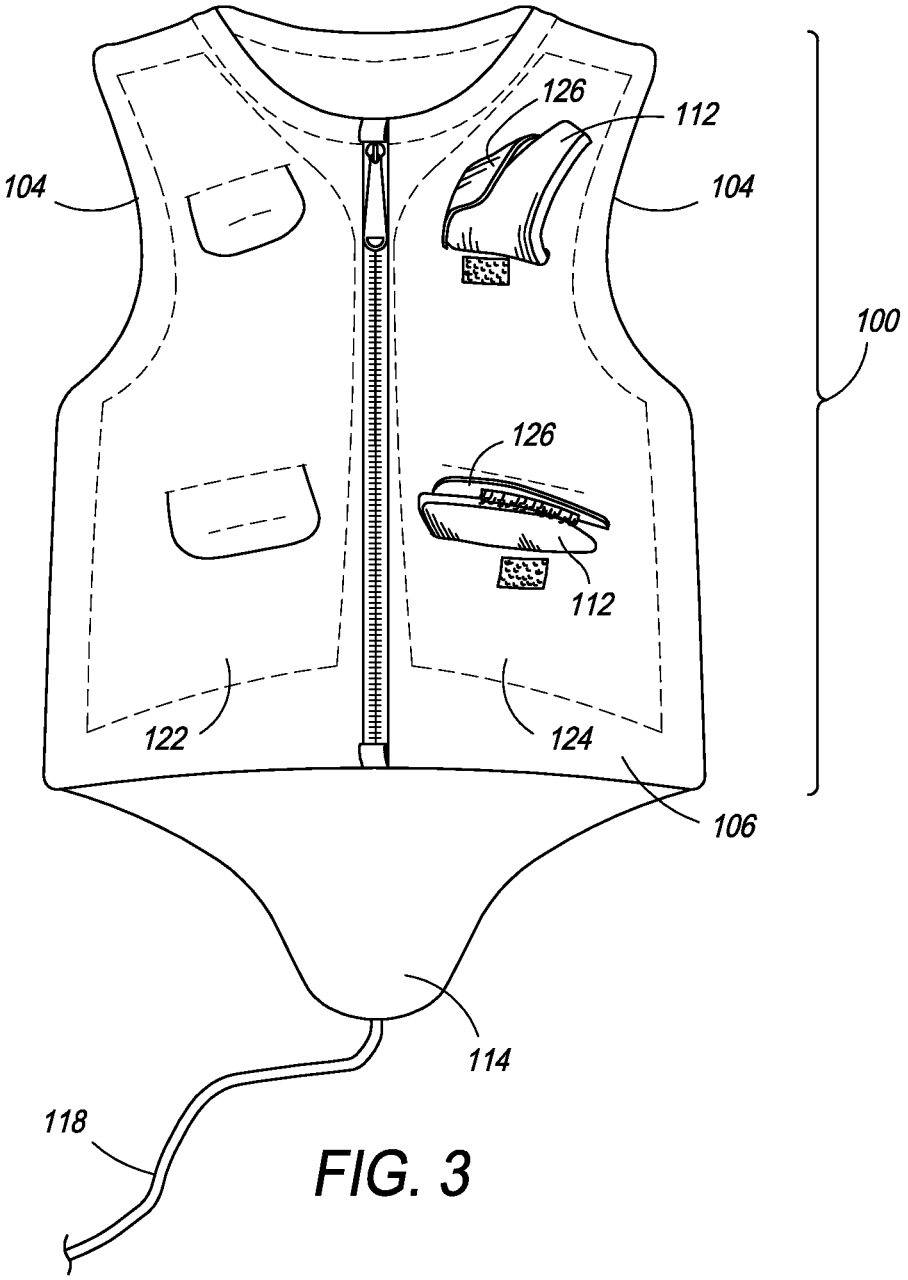
FIG. 3 is a front view of a buoyancy vest showing some buoyancy foam extending from the vest pockets.

Referring to FIGS. 1 and 2, the buoyancy vest 100 can have one or more pockets 110 on the front side 106 and/or back side 108. Referring to FIG. 3, the pockets 110 on the buoyancy vest 100 are configured to hold foam inserts 112. The buoyancy foam inserts 112 are placed into the pockets 110 allowing the person wearing the vest to control how buoyant they are in the water by choosing how many foam inserts 112 to place in the pockets. The foam can be inserted or removed to increase or decrease the buoyancy in the water. Thus one or more can be used and the size and density of the foam insets 112 can be changed. In some embodiments, the foam inserts 112 can be manufactured in various densities and thicknesses thereby allowing the wearer of the vest to further select how much buoyancy they desire. In one embodiment, the foam inserts 112 are made of closed cell foam such as ethylene vinyl acetate ("EVA").

This buoyancy vest 100 is configured to be worn by a person who is bodysurfing so that they can control their buoyancy in the water, however the buoyancy vest 100 could be worn by anyone engaging in a number of types of water sports. The amount of buoyancy is controlled by adding or taking out foam inserts from the vest's 100 pockets 110. Referring to FIG. 2, in one embodiment the back side 108 has an extension on lower end referred to as a tab 114. This tab 114 extends down and rests on the wearer's glutious maximus and can be grabbed by the wearer to pull the vest up and over the wearer's head for removal of the buoyancy vest 100. In some embodiments there is a string or rope 118 attached to the tab 114. This string 118 can be easily reached by the person wearing the vest 100 and therefore allows them to pull on the string 118 and pull the vest 100 up over their head to access the tab 114 and pull the vest over their head to remove.

The buoyancy vest 100 may be constructed from neoprene or other lightweight, stretchable, water, chemical and UV resistant material. In another embodiment the buoyancy vest 100 is constructed from a buoyant material. For example, this material of the vest 100 maybe fabricated from neoprene in various thicknesses. In one embodiment, the thickness of the neoprene or buoyant material is from ½ to 20 millimeter. A thicker neoprene vest provides more buoyancy and allows the surfer to body surf in colder waters since neoprene keeps the body temperature elevated. Referring to FIGS. 2 and 3, in one embodiment, the front side 106 and the back side 108 have a right and a left panel 122 and 124. These panels have an additional layer of neoprene on the inside of the vest which is stretched or glued to the inside of the vest around the circumference of the panel. The pockets 110 of the vest are then cut through the outside of the vest panel 122 and 124, and inserted between the two layers of neoprene formed by the panels 122 and 124. The buoyancy foam 112 can then slide into the pockets made between the two layers of panels 122 and 124, see FIG. 3. In one preferred embodiment, each pocket has an exterior flap 126, which folds over the opening of the pocket and attaches by Velcro® or other means to the exterior surface of the vest. These exterior flaps 126 cover the pockets so that the buoyancy foam 112 does not fall out.

The above description of disclosed embodiments is provided to enable any person skilled in the art to make or use the invention. Various modifications to the embodiments will be readily apparent to those skilled in the art; the generic principals defined herein can be applied to other embodiments without departing from spirit or scope of the invention. Thus, the invention is not intended to be limited to the embodiments shown herein but is to be accorded the widest scope consistent with the principals and novel features disclosed herein.

What is claimed is:

1. A buoyancy apparatus which enables the user to control their buoyancy in the water, comprising:

a buoyancy vest configured for wearing by a user in the water, the vest having a neck opening, a pair of arm holes, a front side and a back side with an exterior and interior surface, at least the front side having one or more pockets on the exterior surface, each pocket having an access opening on the exterior surface;

a plurality of foam inserts which are sized for selective engagement through the access opening and for fitting into the respective pockets for user control of the amount of buoyancy of the user; and the back side of the vest having one or more pockets on the exterior surface of the same dimensions as the respective pockets in the front side of the vest and each having an access opening on the exterior surface of the back side of the vest, whereby a user can selectively place foam inserts in some or all of the pockets in the front side and rear side of the vest to adjust buoyancy;

wherein the foam inserts include inserts of different densities and thicknesses, whereby the user can place inserts of different densities and thicknesses in the pockets in order to adjust the buoyancy of the vest.

2. The apparatus of claim 1, wherein the foam inserts are constructed of a closed cell foam material.

3. The apparatus of claim 1, wherein the vest is constructed from one or more layers of neoprene.

4. The apparatus of claim 3, wherein the neoprene has a thickness in the range from ½ to 20 millimeter.

5. A buoyancy apparatus which enables the user to control their buoyancy in the water, comprising:

a buoyancy vest configured for wearing by a user in the water, the vest having a neck opening, a pair of arm holes, a front side and a back side with an exterior and interior surface, at least the front side having one or more pockets on the exterior surface, each pocket having an access opening on the exterior surface;

a plurality of foam inserts which are sized for selective engagement through the access opening and for fitting into the respective pockets for user control of the amount of buoyancy of the user; and the back side of the vest having one or more pockets on the exterior surface of the same dimensions as the respective pockets in the front side of the vest and each having an access opening on the exterior surface of the back side of the vest, whereby a user can selectively place foam inserts in some or all of the pockets in the front side and rear side of the vest to adjust buoyancy;

wherein the front side and back side of the vest each have right and left panels formed by two layers of neoprene, the pockets are formed between the two layers of neoprene and accessed through the openings in the exterior side of the vest on the front side and back side of the vest, and the foam inserts are positioned between the respective layers of neoprene when placed into the pockets.

6. The apparatus of claim 5, wherein the pockets each have an exterior flap which folds over the opening of the respective pocket and attaches to the exterior of the vest.

7. A method of controlling buoyancy when body surfing, comprising:

donning a buoyancy vest which has front and rear sides each having a plurality of spaced pockets, each pocket having an access opening in an exterior surface of the buoyancy vest for access to the pocket by the wearer;

before or after donning the buoyancy vest, engaging one or more selected foam inserts in some or all of the pockets through the respective access openings in order to adjust the buoyancy of the vest; and controlling buoyancy during use of the buoyancy vest by placing more foam inserts in one or more selected pockets, by removing foam inserts from one or more selected pockets, or by selectively removing first foam inserts of a first density and first thickness from the pockets and replacing the removed first foam inserts with second foam inserts of a second density and second thickness, the first density being different from the second density and the first thickness being different from the second thickness, whereby the buoyancy of the vest is changed.

* * * * *